United States Patent [19]

Henderson, Jr.

[11] 4,008,391

[45] Feb. 15, 1977

[54] DEVICE FOR MEASURING LIGHTING EFFECTIVENESS

[75] Inventor: Alfred J. Henderson, Jr., Hendersonville, N.C.

[73] Assignee: General Electric Company, New York, N.Y.

[22] Filed: Nov. 12, 1975

[21] Appl. No.: 631,096

[52] U.S. Cl. ..... 250/208; 356/121

[51] Int. Cl.[2] ..... H01J 39/12

[58] Field of Search ..... 250/208, 209, 215, 203, 250/204, 214 A, 239; 356/121

[56] References Cited

UNITED STATES PATENTS

| | | | |
|---|---|---|---|
| 2,308,095 | 1/1943 | Meeder | 356/121 |
| 2,714,327 | 8/1955 | Squyer et al. | 250/209 |
| 3,448,273 | 6/1969 | Webb | 250/208 |
| 3,475,613 | 10/1969 | Meyers | 250/208 |

OTHER PUBLICATIONS

Lewin & Holt "A Proposal for ESI Ratings" Illumination Engineering Society Apr. 1973, p. 217.

*Primary Examiner*—Alfred E. Smith
*Assistant Examiner*—David K. Moore
*Attorney, Agent, or Firm*—Sidney Greenberg

[57] ABSTRACT

Instrument for measuring the quality of light illuminating a work area. The device comprises four photocells arranged in a cubical housing facing in different directions and connected to calibrated operational amplifiers and an analog divider. A volt meter with suitably calibrated scale is connected to the analog divider to provide a direct reading of the ratio of quantity of light from the different directions.

9 Claims, 4 Drawing Figures

DEVICE FOR MEASURING LIGHTING EFFECTIVENESS

The present invention relates to light measuring devices, and more particularly to an instrument for measuring lighting effectiveness in a work area.

It is an object of the invention to provide an improved device for measuring the quality of illumination in a working area.

It is a particular object of the invention to provide an instrument of the above type which directly measures the K-factor of a lighting installation by the Illumination Ratio Method (IRM), as more fully explained below and from which other light quality factors may be derived, such as Contrast Rendition Factor (CRF) and Lighting Effectiveness Factor (LEF).

Other objects and advantages will become apparent from the following description and the appended claims.

The Illumination Ratio Method provides for an estimate to be made of the Contrast Rendition Factor (CRF) of a lighting system experienced at a given observer position and viewing direction. The method derives its name from the factor $$K = \frac{S_1 + S_2}{H + F},$$

which is the ratio of the sum of vertical illumination (footcandles) 90° left and right ($S_1$and $S_2$) of the viewing direction to the sum of the vertical forward illumination (F) and the horizontal illumination (H) at the viewing position. This quantity is correlated with CRF by empirical observation. This method and its application are disclosed in detail in the article by Jones and Sampson, "Contrast Rendition Factor Calculation and Measurement for the Standard Classroom Task", Journal of the Illuminating Engineering Society, Vol. 1 No. 2, January 1972, pages 128–132.

With the aforementioned objects in view, the present invention in a broad aspect relates to a device for measuring quality of illumination comprising, in combination, first and second light sensing means, first and second circuit means respectively associated with the first and second light sensing means for producing respective outputs proportional to the arithmetic sum of illumination levels on the respective first and second light sensing means, electronic means connected to the outputs of the first and second circuit means for performing an arithmetic operation on the same, and indicating means for displaying the resultant output of the electronic means.

The invention will be better understood from the following description taken in conjunction with the accompanying drawings, in which.

Figure 1:
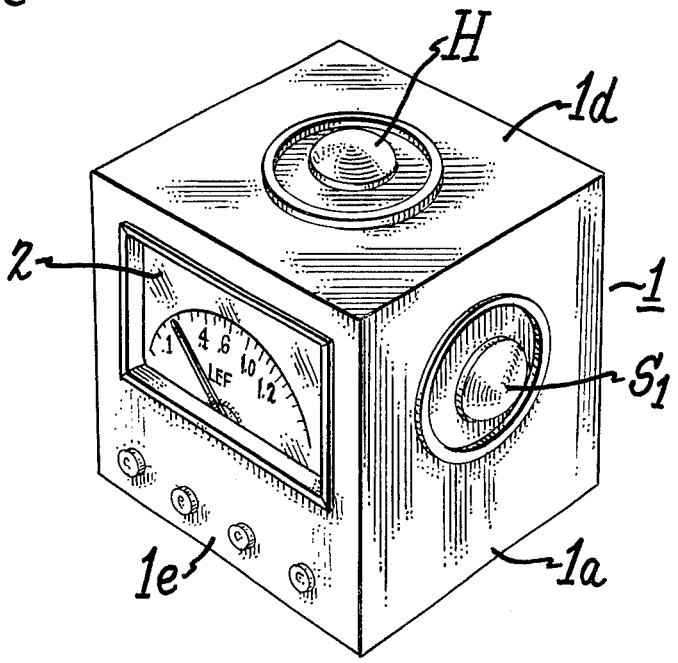
FIG. 1 is a rear perspective view of a light measuring device in which the invention may be embodied.
Figure 2:
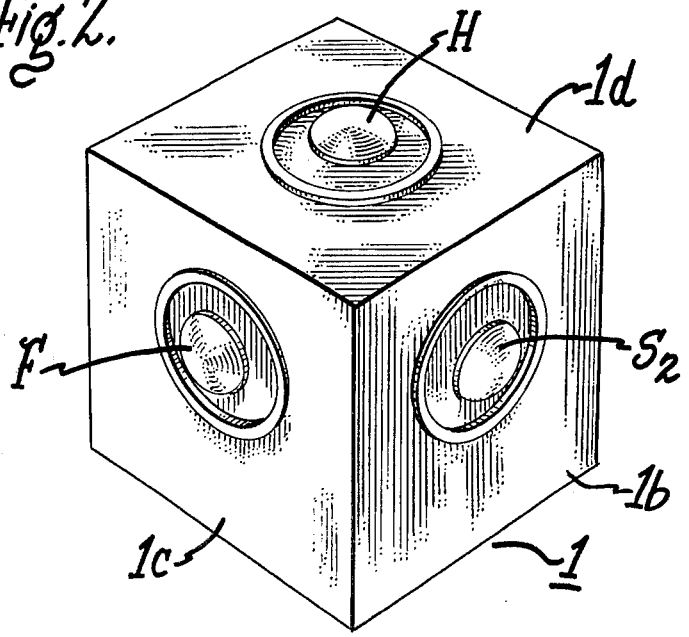
FIG. 2 is a front perspective view of the light measuring device.
Figure 3:
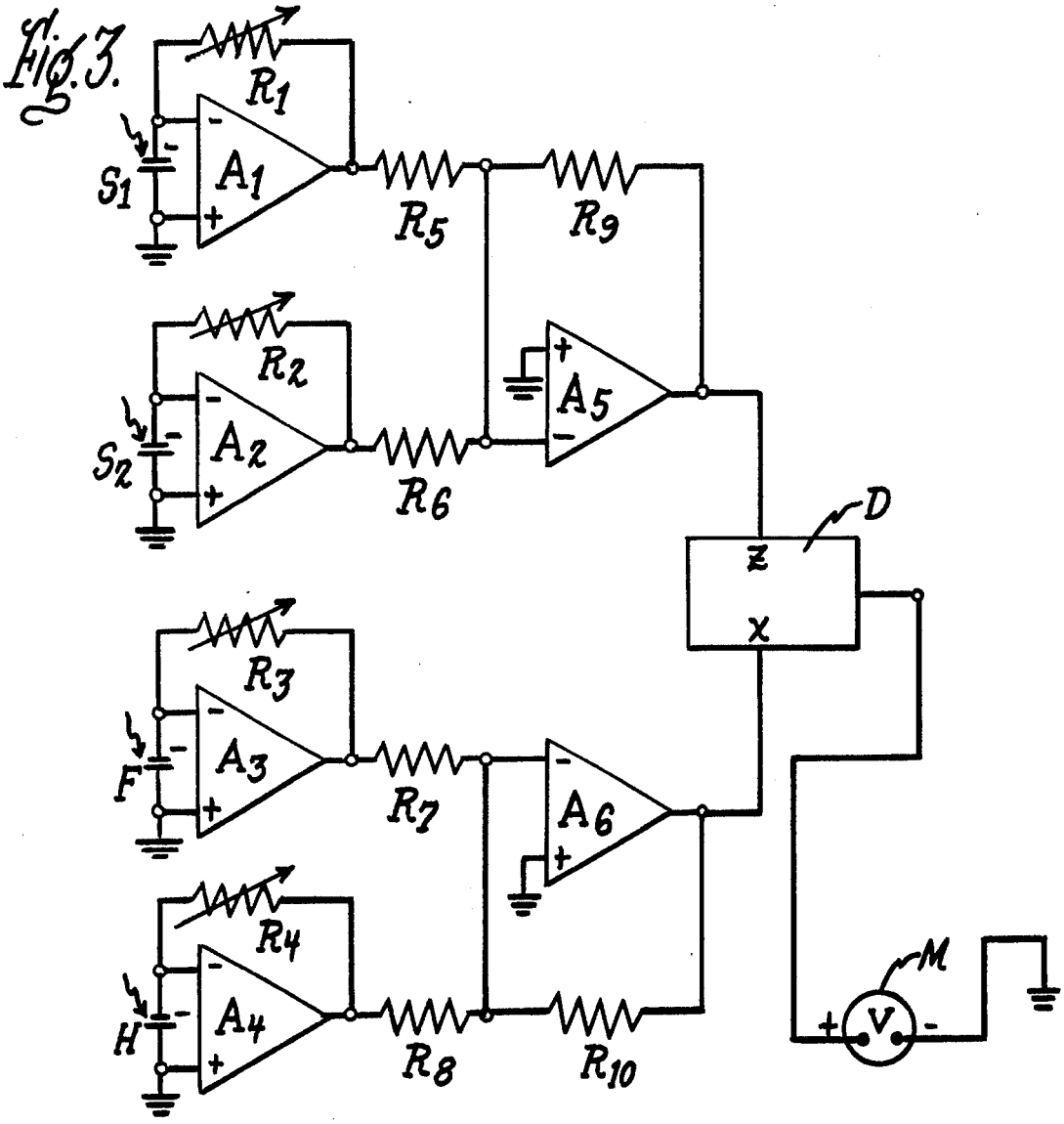
FIG. 3 is a diagram of a circuit which may be embodied in the light measuring device in accordance with the invention.

In the typical circuit embodiment shown in FIG. 3, the circuit comprises photovoltaic cells $S_1$ and $S_2$ arranged in opposite side walls 1*a*, 1*b* of cubical housing 1 (see FIGS. 1 and 2) so as to face in opposite directions, photovoltaic cell F in the front wall 1*c* of housing 1 facing in the forward direction, and photovoltaic cell H in the top wall 1*d* of housing 1 facing upwardly. Meter scale 2 is arranged in rear housing wall 1*e*. In the normal operating position of the device, the operator is located at the rear of the housing in position to read the meter scale. The respective photocells thus are arranged so that photocell H measures the illumination on a horizontal plane, while photocells $S_1$, $S_2$ and F measure the illumination on vertical planes on their respective side and front housing walls. A flat black shield may be employed beneath the device to provide a plane of low reflectance.

In the embodiment illustrated in FIG. 3, the outputs of photocells $S_1$ and $S_2$ are connected via operational amplifiers $A_1$ and $A_2$ and input resistors $R_5$ and $R_6$ to the summing junction of operational amplifier $A_5$. Similarly, photocells F and H are connected via operational amplifiers $A_3$ and $A_4$ and input resistors $R_7$ and $R_8$ to the summing junction of operational amplifier $A_6$.

Variable resistors $R_1 - R_4$ connected across the respective operational amplifiers $A_1 - A_4$ are gain resistors and are so adjusted in conjunction with the latter amplifiers that each photocell-amplifier combination has the same output voltage for the same input light level. Amplifiers $A_1 - A_4$ serve to convert the output of the respective photocells to a voltage proportional to that current, and hence these amplifiers are referred to herein as conversion operational amplifiers.

Resistors $R_9$ and $R_{10}$ connected respectively across summing operational amplifiers $A_5$ and $A_6$ are feedback resistors, and in conjunction with the input resistors determine the gain of the latter amplifiers.

As shown in FIG. 3, the outputs of amplifiers $A_5$ and $A_6$ are connected respectively to the X and Z inputs of an analog divider circuit D. This circuit may be constituted by a monolithic integrated circuit two quadrant divider, such as commercially available from Analog Devices, Inc. of Norwood. Mass. under the designation AD 532.

Typically, resistors $R_5 - R_{10}$ all have the same value so that operational amplifiers $A_5$ and $A_6$ act as unity gain summing amplifiers. As a result, one input to the divider D is $Z = g(S_1 + S_2)$ and the other is $X = g(F + H)$ where $g$ is the gain of amplifiers $A_1 - A_4$ in volts/footcandle.

Analog divider D is adjusted so that the output voltage is proportional to $$K = \frac{S_1 + S_2}{H + F} \quad (1)$$

Connected to the output of electronic analog divider D is volt meter M, which is provided with an indicating scale 2 calibrated to provide a reading of LEF directly.

As disclosed in the aforementioned article by Jones and Sampson, the relation between CRF and K may be expressed under the circumstances of their investigation by the equation $$CRF = 0.563 + 1.066K - 0.598K^2 \quad (2)$$

Given this quantity, the Lighting Effectiveness Factor (LEF) can be obtained by procedures set forth by the Illuminating Engineering Society, and finally the Equivalent Sphere Illumination (ESI) can be obtained from the relationship $$ESI = LEF \times H \quad (3)$$

In an article by Lewin and Holt in the Journal of the Illuminating Engineering Society, April 1973, page 217, there is disclosed a plot for determining ESI vs. H for a number of values of CRF. For horizontal illumination of 100 footcandles, this information may be represented by the relation:

$$LEF = 0.00042\, e^{7.775\,(CRF)} \quad (4)$$

Combining equations (2) and (4) gives the relation:

$$LEF = 0.03344\, e^{(8.29K - 4.65K^2)} \quad (5)$$

Curves based on relations (2) and (5) above can be used to provide a meter scale for reading CRF and LEF directly when the voltage across the meter is proportional to K.

Figure 4:
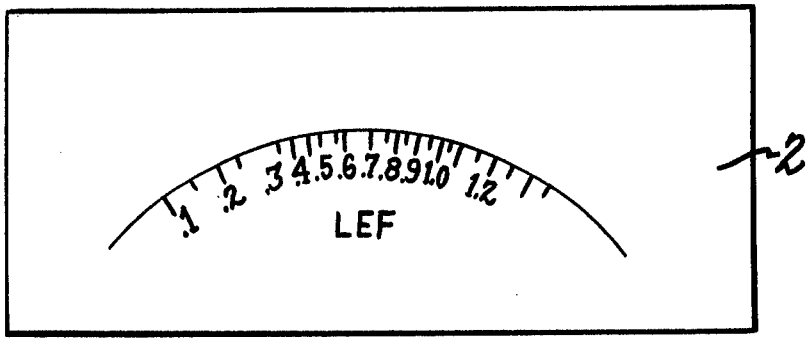
FIG. 4 is a view of the meter scale employed in the light measuring device.

Shown in FIG. 4 is a view of meter indicator 2 having a scale in terms of LEF obtained as explained above. Thus, a direct reading of LEF is made possible by virtue of the described device. Other calibrations may be employed for meter scale 2 if desired, such as those indicacting K-factor or CRF directly, or other scale calibrations indicating a function of K-factor.

In the use of the described device the bottom of the instrument with a suitable flat black shield attached to its bottom plane may be mounted on a suitable support such as a tripod, or simply placed on a desk top or other surface in the position where the observer is to make a reading of the lighting conditions at the task area.

By virtue of the described device a number of advantages are obtained, in addition to those already described. The arrangement of the photocells is such that they have a fixed geometric relationship with respect to one another. Further, the indicating meter is so arranged that the viewer must position himself at the rear of the instrument so that his body does not shadow the instrument or that the reflectivity of his clothing does not influence the measurement. Standardized body shadow effects may be simulated by the provision of an appropriate shield in the plane of the meter face.

Various modifications may be made in the described device without going beyond the scope of the invention. For example, while the photosensors may be in the form of photovoltaic cells for which no additional electrical supply need be provided, the photocells may alternatively be cadmium sulfide variable resistance devices for which a separate voltage supply may be provided. Furthermore, while operational amplifiers $A_1 - A_4$ are shown connected between the respective photocells and amplifiers $A_5$ and $A_6$, in appropriate situations amplifiers $A_1 - A_4$ may be omitted and the pairs of photocells each having a parallel load resistor may be directly connected to their respective amplifiers $A_5$ and $A_6$.

While the circuit has been described with reference to the use specifically of an analog divider device to divide the output voltages of amplifiers 5 and 6, other forms of devices may be used where appropriate to perform other arithmetic operations, such as addition, subtraction or multiplication to provide a measurement of other lighting quality parameters.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by Letters Patent of the United States is:

1. A device for measuring quality of illumination comprising, in combination, first and second light sensing means, first and second circuit means respectively associated with said first and second light sensing means for producing respective outputs proportional to the arithmetic sum of illumination levels on the respective first and second light sensing means, electronic means connected to the outputs of said first and second circuit means for performing an arithmetic division on the same, and indicating means connected to said electronic means for displaying the resultant output of said electronic means.

2. A device as defined in claim 1, said first and second circuit means comprising operational amplifier means.

3. A device as defined in claim 1, said electronic means comprising an analog divider device.

4. A device as defined in claim 1, said first and second light sensing means comprising two pairs of photosensitive devices facing in different directions.

5. A device as defined in claim 4, wherein one pair of said photosensitive devices include two photocells facing laterally in opposite directions and the other pair comprises two photocells facing in directions 90° relative to each other and 90° relative to said first mentioned photocells.

6. A device as defined in claim 1, said first and second circuit means comprising first and second conversion operational amplifier means, respectively connected to said first and second light sensing means, and first and second summing operational amplifier means respectively connected to said first and second conversion operational amplifier means.

7. A device as defined in claim 6, said first and second light sensing means each comprising a pair of photocells, said first and second conversion operational amplifier means each comprising a pair of conversion operational amplifiers respectively connected to said photocells, said first and second summing operational amplifier means each connected to a different pair of said conversion operational amplifiers.

8. A device as defined in claim 7, including a housing having a top wall, opposite side walls, a front wall and a rear wall, the photocells of one pair thereof being arranged respectively in said opposite side walls, the photocells of the other pair thereof being arranged respectively in said front and top walls, and said indicating means being arranged in said rear wall.

9. A device as defined in claim 8, said indicating means comprising a volt meter and a scale associated therewith, said scale being calibrated to indicate a function of K-factor.

* * * * *